US006591427B1

(12) United States Patent
Bennett

(10) Patent No.: US 6,591,427 B1
(45) Date of Patent: Jul. 15, 2003

(54) PROTECTIVE GARMENT AND PROCESS FOR ITS PRODUCTION

(75) Inventor: Brian G. Bennett, Ormskirk (GB)

(73) Assignee: Bennett Safetywear Limited (GB)

( * ) Notice: Subject to any disclaimer, the term of this patent is extended or adjusted under 35 U.S.C. 154(b) by 0 days.

(21) Appl. No.: 09/926,139

(22) PCT Filed: Mar. 10, 2000

(86) PCT No.: PCT/GB00/00880

§ 371 (c)(1),
(2), (4) Date: Nov. 26, 2001

(87) PCT Pub. No.: WO00/53039

PCT Pub. Date: Sep. 14, 2000

(30) Foreign Application Priority Data

Oct. 3, 1999 (GB) ..... 9905349

(51) Int. Cl.[7] ..... A41D 19/00

(52) U.S. Cl. ..... 2/161.8; 2/161.6; 442/121; 442/77; 428/408

(58) Field of Search ..... 442/77, 76, 86, 442/121, 122, 123; 428/408, 367, 902, 447.2; 2/161.8, 161.6

(56) References Cited

U.S. PATENT DOCUMENTS

| | | | | |
|---|---|---|---|---|
| 4,714,649 A | * | 12/1987 | Edwards | 428/408 |
| 5,230,960 A | * | 7/1993 | Iizuka | 423/447.2 |
| 5,715,539 A | * | 2/1998 | Benecki et al. | 2/160 |
| 5,743,775 A | * | 4/1998 | Baurmeister | 2/16 |
| 6,235,388 B1 | * | 5/2001 | Yamamoto et al. | 428/357 |

FOREIGN PATENT DOCUMENTS

| | | | | |
|---|---|---|---|---|
| WO | WO-8707657 A | * | 12/1987 | A62B/17/00 |

* cited by examiner

*Primary Examiner*—John J. Calvert
*Assistant Examiner*—Robert H. Muromoto
(74) *Attorney, Agent, or Firm*—John S. Hale; Gipple & Hale

(57) ABSTRACT

A protective garment such as a glove is knitted from a yarn comprising a heat-resistant core and a core covering comprising a carbon based yarn. The knitted garment is treated (e.g. by heating) to at least partially decompose the carbon based yarn to form activated charcoal in order to provide increased protection against chemical and/or biological risks.

15 Claims, 4 Drawing Sheets

PROTECTIVE GARMENT AND PROCESS FOR ITS PRODUCTION

The present invention relates to protective garments and in particular, but not exclusively, to protective gloves (including gauntlets, mitts, mittens and the like) incorporating activated charcoal.

There is a need for protective gloves and other garments which incorporate activated charcoal, for use by those who may be exposed to chemical or biological risks, for example fire fighters. Although there are several types of fabric available incorporating activated charcoal which are used for clothing, they are generally not suitable for manufacturing gloves since gloves can be expected to be flexed repeatedly in use and the known fabrics provide little or no stretch. Moreover, the existing gloves can be time consuming to manufacture.

The known types of fabric incorporating activated charcoal comprise several yarns, one or more of which is a yarn of activated carbon which, when knitted with the other yarns, forms an integral part of the fabric and provides a protective function against chemical, biological and other risks. Unfortunately, the use of carbon yarn results in products that are dusty and weak, which is not acceptable for a glove which would be expected to be flexed continuously and repeatedly.

It is an object of the present invention to provide a process of manufacturing gloves containing activated charcoal which overcomes or alleviates the problems associated with the prior art. In accordance with a first aspect of the present invention, a process of manufacturing a protective garment comprises knitting a garment from a yarn having a heat-resistant core and a core covering comprising a carbon based yarn compound and treating the knitted garment to at least partially decompose the carbon based yarn to form activated charcoal.

In accordance with a second aspect of the present invention, a protective garment is made from a yarn having a heat-resistant core and a core covering comprising a carbon based yarn which has been at least partially decomposed to form activated charcoal.

It is believed that the activated charcoal formed on treating the garment is bound to the heat-resistant core, resulting in a fabric from which little or no activated charcoal escapes. Moreover, the use of a heat-resistant core results in a garment which shrinks much less than the prior art garments and at a-more predictable rate.

The carbon based yarn may be decomposed partially or substantially completely to form activated charcoal.

Preferably, the treatment of the knitted garment to at least partially decompose the carbon based yarn comprises heating.

The yarn may comprise a core spun yarn and may comprise a steel, ceramic or glass core. The covering may comprise viscose, either filament or spun, or lyocell.

Preferably, the knitted garment is located on a former during the heating stage to assist in reducing and/or controlling the degree of shrinkage and to assist in retaining the shape of the garment during heating.

Once the garment has been produced then one or more coatings may optionally be applied to its surface. For example, a curable plastisol such as PVC or latex may be screenprinted onto the garment in a predetermined pattern, eg: a matrix of dots. Alternatively or in addition, the garment may be dipped into the curable plastisol and subsequently cured. The plastisol may, for example, contain powdered activated carbon particles, thus increasing the chemical absorption characteristics of the glove and strengthening the glove considerably.

If desired, one or more further coatings may be applied. For example, a further series of dots (eg: PVC dots) may be applied to the surface of the garment to increase abrasion resistance.

The present invention also includes a protective garment made in accordance with the first aspect of the invention.

By way of example only, a specific embodiment of the present invention will now be described, with reference to the accompanying drawings in which.

Figure 1:
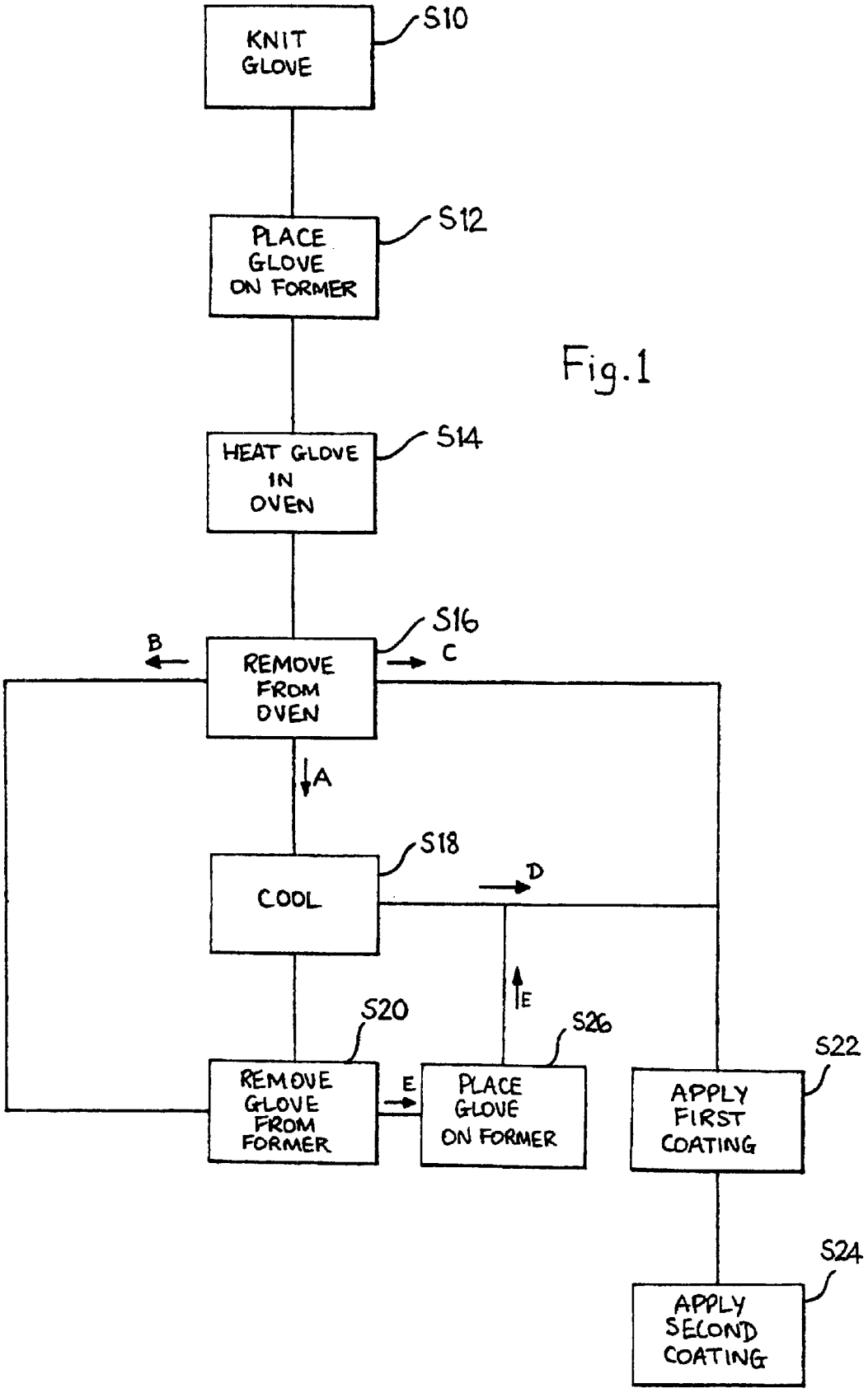
FIG. 1 is a flow diagram illustrating one method of producing gloves in accordance with the present invention.

Referring firstly to FIG. 1, at Step 10 a glove is knitted in a conventional manner on a standard glove knitting machine. However, the yarn which is used comprises a core spun yarn consisting of a heat-resistant core with a covering comprising a carbon based yarn, i.e. a yarn comprising carbon in a chemically bonded form. For example, the heat-resistant core may comprise metal (e.g. steel), ceramic or glass. The coating may, for example, comprise viscose, either filament or spun or lyocell. Such yarns are already known and an example of these yarns is a yarn with a glass core and a viscose coating (possibly treated with a flame-retardant treatment) spun on a DREF machine.

Figure 2:
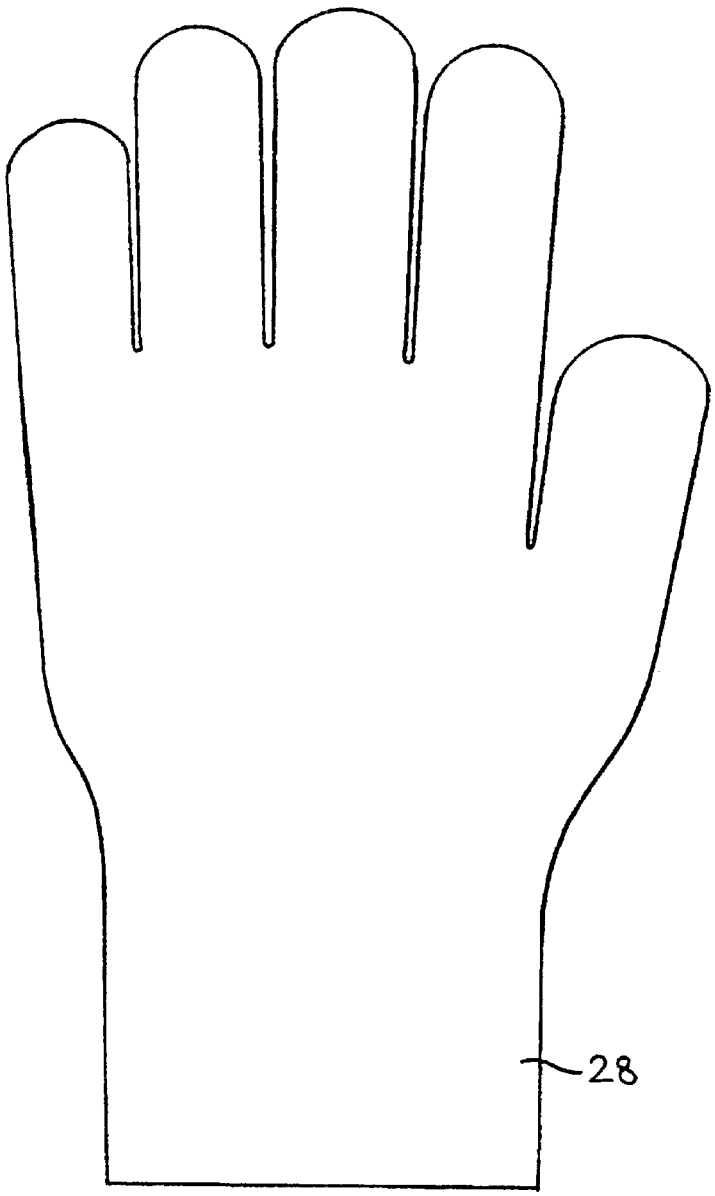
FIG. 2 is the plan view of a former which may be used in the method of the present invention.
Figure 3:
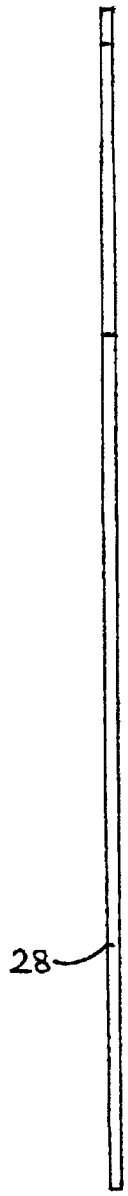
FIG. 3 is a side view of the former illustrated in FIG. 2.

At Step 12 the knitted glove is then placed on a former 28, one example of which is illustrated in FIGS. 2 and 3. The former corresponds generally to the shape of the glove and will vary in size and shape, depending upon the size and shape of the glove to be produced. In general, however, the former will be planar, as illustrated in FIG. 3 and will be of a heat-resistant material, preferably metal.

After the glove has been placed on the former, at Step 14 the former with the glove positioned thereon is placed in an oven and is heated to a temperature at which carbonisation of the carbon based yarn coating of the core spun yarn takes place. The application of heat may be sufficient to result in substantially complete carbonisation of the carbon-containing coating or may, if desired, be adjusted in order to produce partial carbonisation.

One option is to apply a high heat flux to the garment at step 14 in order to carbonise the outer portions of the yarn but to retain the inner portions intact. This is thought to increase the retention within the garment of the activated carbon formed during heating.

By using known techniques such as plating or making pile fabric it is possible to build a garment in one operation using advanced heat resistant fibres such as the aramids, PBI and PBO. By utilising a high heat flux with such materials, a temperature profile can be created so that different parts of the fabric would be at different temperatures, thus carbonising one part of the material but leaving another part intact. The use of a high performance material such as those described facilitates this partial carbonisation, since it can be difficult to control the temperature accurately.

After being heated at the required temperature and for the appropriate length of time, the former and glove are removed from the oven at Step 16. Normally the process will proceed to Step 18 (path A) where the glove is allowed to cool and at Step 20 it is removed from the former. As an alternative, after the glove is removed from the oven it is removed from the former at Step 20 before being allowed to cool substantially (path B).

Figure 4:
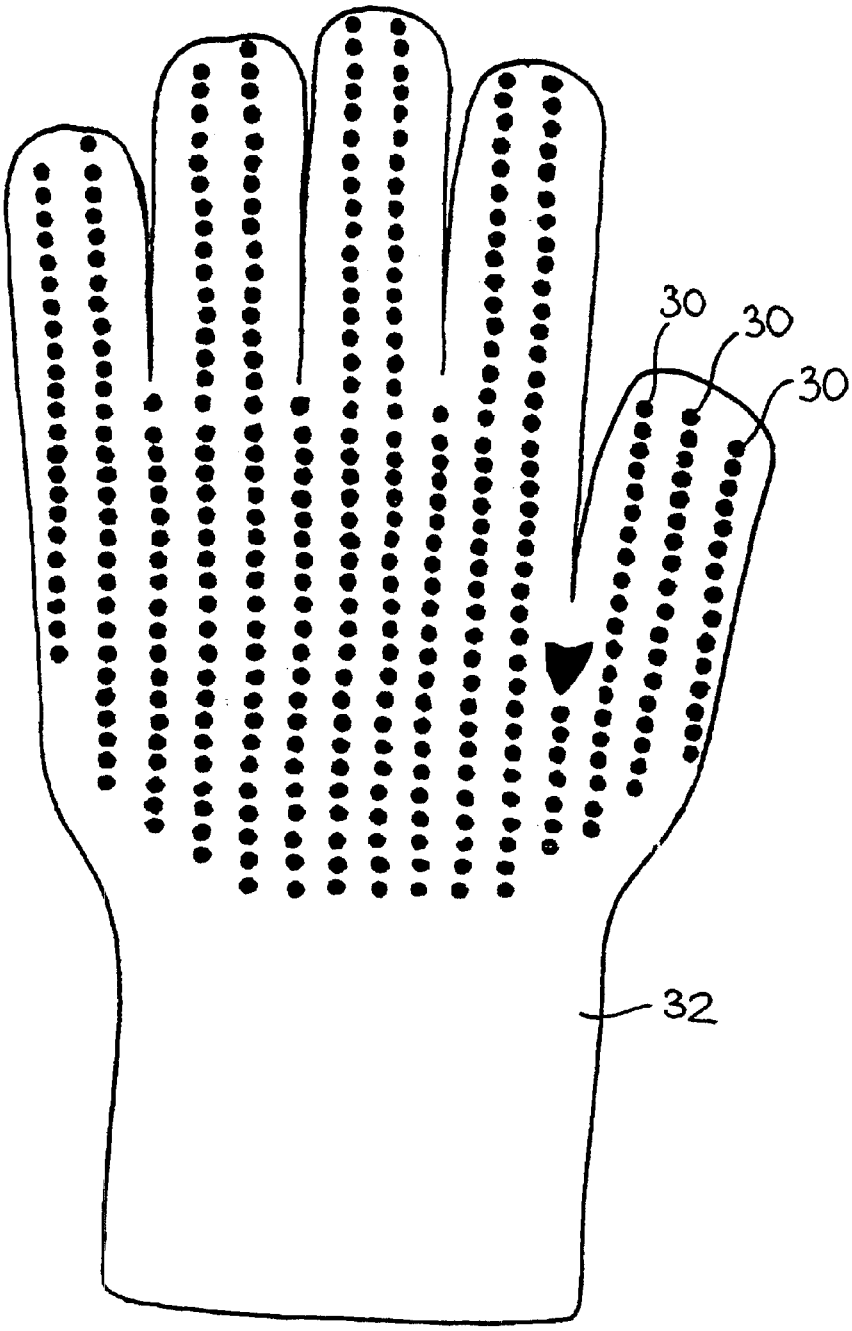
FIG. 4 is a plan view of a glove manufactured in accordance with the present invention, to which a first coating has been applied.

Alternatively, after removing the former and glove from the oven at Step 16 or after cooling the glove at Step 18, the glove, still on the former, may have a coating applied to it at Step 22 (paths C and D). For example, a curable plastisol such as PVC may be screenprinted onto the glove by conventional techniques or may be applied to a or may be applied by a conventional dipping process. The plastisol may contain powdered activated carbon particles which would increase the chemical absorption characteristics of the glove and would also strengthen the product significantly. For example the technique described in EP-A-0118618 (von Blücher et al) may be used. The plastisol may be applied in a predetermined pattern, eg: in the form of a matrix of circular dots 30 on the surface of the glove 32, as illustrated in FIG. 4. Of course, other coatings may be applied instead.

If the coating is applied by dipping, it will normally form a larger continuous area of coating material.

Figure 5:
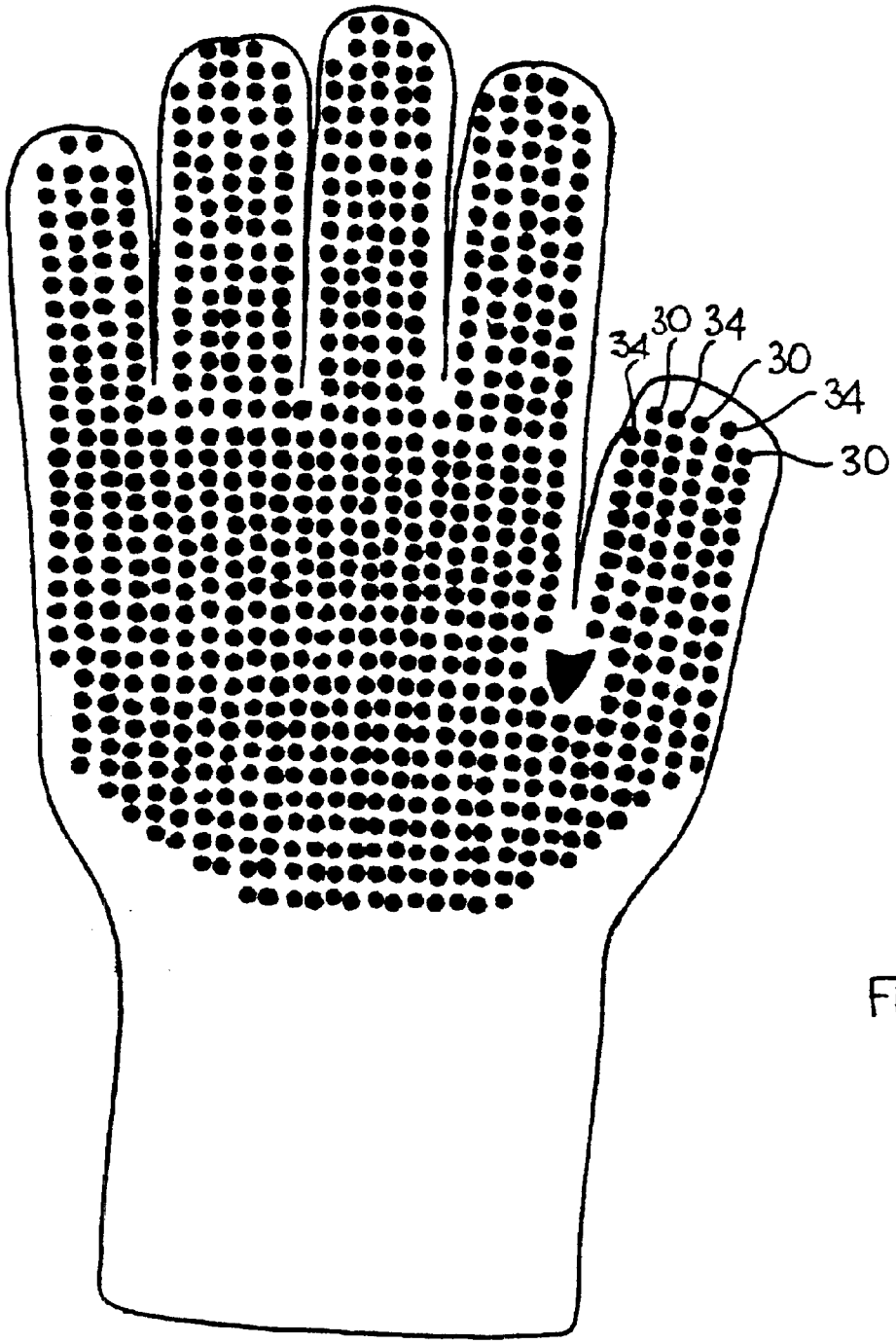
FIG. 5 is a plan view of the glove of FIG. 4, to which a second coating has been applied.

Optionally, at Step 24, a further coating may be applied. In the example given, and as illustrated in FIG. 5, the further coating is screenprinted in the form of a matrix of circular dots 34 of PVC material, to increase abrasion resistance. In the example given rows of dots 34 of the second coating are shown as being applied in between rows of dots 30 of the first coating. However, the number, shape and position of the dots can be varied as required.

As a variant, the first and/or second coatings could be applied some time after manufacture of the glove itself, in which case it would be necessary to place the glove on a former prior to application of the coating, as illustrated schematically at Step 26 (path E) before carrying out Step 22 and/or Step 24.

Further coatings could be applied, if desired.

The glove could be for use as a protective glove in its own right and/or as a lining inside a different glove. For example, the glove may be used as a lining inside a protective leather glove, which would be particularly suitable for use by the fire services. An additional benefit of using a core spun yarn having a steel, glass or ceramic core would be that the glove (or liner) would additionally be cut resistant.

The invention is not restricted to the details of the foregoing embodiment. For example, although the specific embodiment is described in the context of gloves, the invention is equally applicable to other garments such as, but not exclusively, gauntlets, mitts, mittens (with and without fingers, thumbs or cuffs), socks and underwear.

What is claimed is:

1. A process for manufacturing a protective garment, comprising knitting a garment from a core spun yarn having a heat-resistant core and a core covering comprising a carbon based yarn compound and treating the knitted garment to at least partially decompose the carbon based yarn to form activated charcoal.

2. A process as claimed in claim 1, wherein the treatment of the knitted garment to at least partially decompose the carbon based yarn is heating.

3. A process as claimed in claim 1 wherein the knitted garment is located on a former during said treating step.

4. A process as claimed in claim 1 including the step of applying one or more coatings to the surface of the garment.

5. A process as claimed in claim 1 including the step of applying a coating to said garment in a plurality if discrete, separate areas on said garment. surface of the garment.

6. A protective garment knitted from a yarn comprising a heat-resistant core and a core covering comprising a carbon based yarn which garment has been treated to at least partially decompose the carbon based yarn to form activated charcoal.

7. A protective garment as claimed in claim 6 including one or more coating applied to the surface of the garment to protect said activated charcoal.

8. A protective garment as claimed in claim 6 including a coating applied to the garment in a plurality of discrete, separate areas to protect said activated charcoal in said discrete separate areas.

9. A process as claimed in claim 1, wherein said garment is a glove.

10. A protective garment as claimed in claim 6, wherein said garment is a glove.

11. A process for manufacturing a protective glove, comprising knitting a glove from a core spun yarn having a heat-resistant core and a core covering comprising a carbon based yarn compound and heat treating the knitted garment to at least partially decompose the carbon based yarn to form an activated charcoal layer with the knitted garment being located on a former during said heat treating step.

12. A process as claimed in claim 11 including the step of applying one or more coatings to the surface of the glove to protect a carbonized layer.

13. A process as claimed in claim 11 including a step of applying a coating to said glove in a plurality of discrete, separate areas to protect a carbonized layer on said discrete, separate areas.

14. A process as claimed in claim 12, wherein at least one of said coatings is a curable plastisol.

15. A process as claimed in claim 14, wherein said plastisol contains powdered activated carbon particles.

* * * * *

UNITED STATES PATENT AND TRADEMARK OFFICE

CERTIFICATE OF CORRECTION

PATENT NO. : 6,591,427 B1
DATED : July 15, 2003
INVENTOR(S) : Brian G. Bennett

It is certified that error appears in the above-identified patent and that said Letters Patent is hereby corrected as shown below:

Title page,
Item [30], Foreign Application Priority Data, the priority date should read -- March 10, 1999 --.

Signed and Sealed this

Sixteenth Day of September, 2003

JAMES E. ROGAN
*Director of the United States Patent and Trademark Office*